United States Patent [19]

Borges

[11] Patent Number: 4,655,011

[45] Date of Patent: Apr. 7, 1987

[54] PREFABRICATED BUILDING SYSTEM

[76] Inventor: Anthony A. Borges, 18601 S. Main St., Gardena, Calif. 90248

[21] Appl. No.: 649,624

[22] Filed: Sep. 12, 1984

[51] Int. Cl.[4] ..... B23Q 3/18; E03C 1/00; E04B 2/08; E04B 2/56

[52] U.S. Cl. ..... 52/79.1; 4/191; 29/157 R; 29/464; 29/469; 52/34

[58] Field of Search ..... 52/79.1, 79.7, 34, 35, 52/173 R, 220, 221, 745; 4/514, 191, 663, 664; 29/157 R, 469, 464

[56] References Cited

U.S. PATENT DOCUMENTS

| | | | |
|---|---|---|---|
| 1,864,184 | 6/1932 | Cavert | 4/191 |
| 2,653,357 | 9/1953 | Saunders et al. | 4/191 |
| 2,787,027 | 4/1957 | Baker | 4/191 |
| 3,148,380 | 9/1964 | Hanson | 52/34 X |
| 3,221,454 | 12/1965 | Togni | 52/34 X |
| 3,694,973 | 10/1972 | Unger | 52/79.1 |
| 3,707,165 | 12/1972 | Stahl | 52/34 X |
| 3,766,574 | 10/1973 | Smid, Jr. | 4/191 |
| 3,979,864 | 9/1976 | Tillie | 52/745 X |

FOREIGN PATENT DOCUMENTS

| | | | |
|---|---|---|---|
| 2204518 | 7/1979 | Fed. Rep. of Germany | 4/191 |

*Primary Examiner*—Stuart S. Levy
*Assistant Examiner*—Lynn M. Sohacki
*Attorney, Agent, or Firm*—Quaintance, Murphy & Presta

[57] ABSTRACT

A prefabricated building system comprising a portable wall unit having a supporting frame and utility apparatus mounted on the supporting frame. The utility apparatus preferably is adjustably mounted on the supporting frame and may comprise plumbing, electrical, heating and/or cooling apparatus for the rooms adjacent to the portable wall unit in the building in which it is to be installed. Prefabricated wall partitions for the adjacent rooms can be assembled with the portable wall unit before shipment to the building site or at the building site. The portable wall unit is provided with means for aligning the wall unit with the adjacent wall partitions to facilitate the assembly thereof.

4 Claims, 5 Drawing Figures

FIG.1
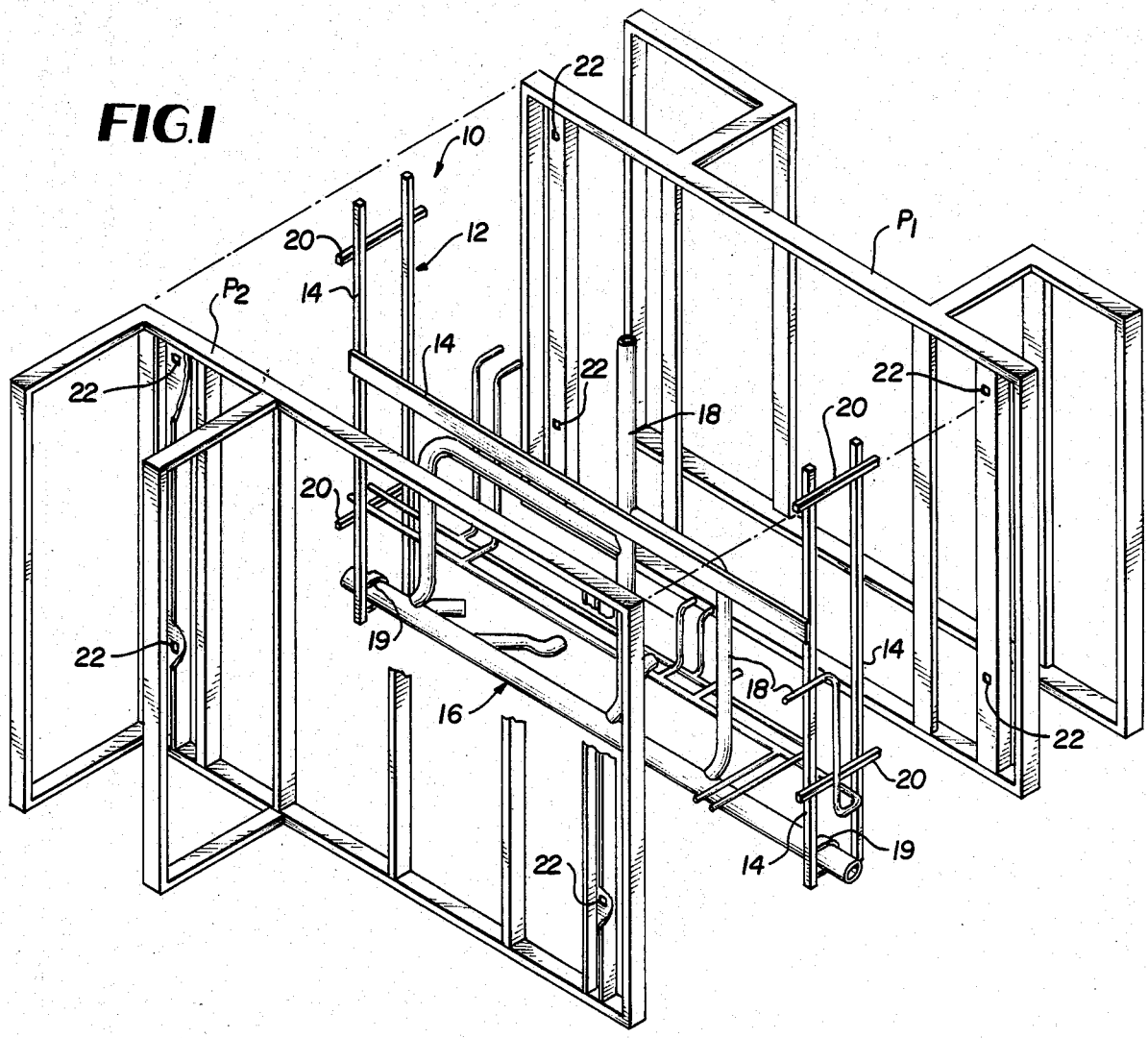
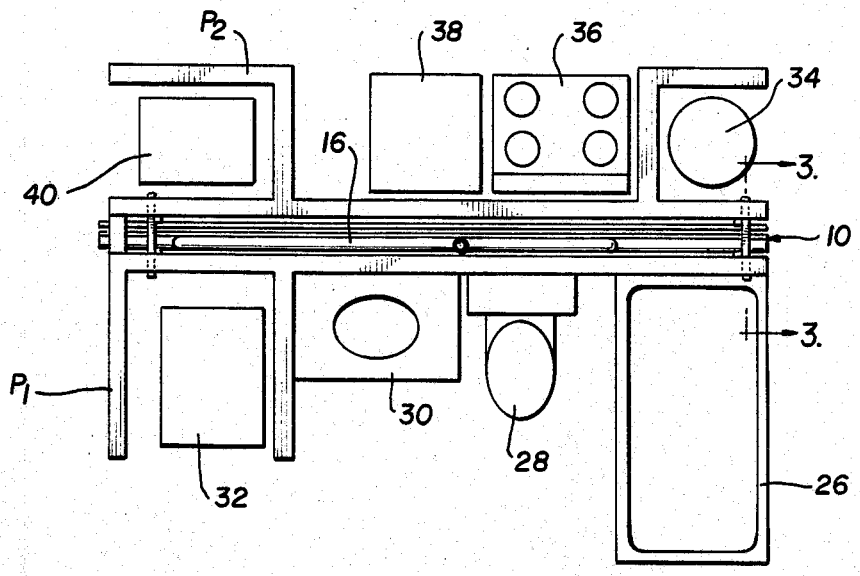
FIG.2

PREFABRICATED BUILDING SYSTEM

BACKGROUND OF THE INVENTION

The present invention relates to a prefabricated building system and, more particularly, to such a system wherein a portable wall unit is assembled with the necessary utility apparatus such as plumbing, electrical, heating and/or cooling apparatus for the adjacent rooms in the building in which the wall unit is to be installed.

At the present time, the plumbing, electrical, heating and/or cooling apparatus for homes or other buildings are constructed at the site at appropriate times during the construction of the homes or the buildings. This results in high material and labor costs.

In some instances, attempts have been made to prefabricate rooms or the like with the required plumbing, electrical, heating and/or cooling requirements. Such prefabricated rooms have been heavy and/or bulky to ship, especially where the room has been prefabricated on a slab formed of concrete or the like.

Accordingly, a need has arisen for a system for prefabricating a structure with the utility requirements for a home or other building, such as plumbing, electrical, heating and/or cooling, such that the prefabricated structure is easy to ship to the building site and is easy to install at the building site. The prefabricated building system of the present invention fulfills this need.

SUMMARY OF THE INVENTION

In the prefabricated building system and method of the present invention, a portable wall unit is assembled with the required utility apparatus such as plumbing, electrical, heating and/or cooling for the rooms adjacent to the wall unit when it is installed at the building site.

The wall unit comprises a supporting frame formed of lightweight elements such as metal tubing which serve to support the required plumbing, electrical, heating, cooling or other utility apparatus installed therein. The portable wall unit is lightweight and compact so that it can be easily shipped to the building site. Also, the wall unit comprises means for aligning it with adjacent prefabricated partitions for the rooms adjacent the wall unit in the building in which it is installed. The utility apparatus can be movably mounted on the supporting frame so that it can be adjusted at the building site.

In practice, the portable wall unit and the required utility apparatus, such as plumbing, electrical or the like, are peassembled at a manufacturing site and are shipped, along with portable partitions for the rooms adjacent the wall unit, to the building site. At the building site, the portable wall unit and the adjacent partitions are placed on a slab and secured together. Alternatively, the wall unit and partitions could be assembled before shipment to the building site. Thereafter, the utilities or appliances in the rooms, such as bathroom or kitchen fixtures, can be readily connected to the utility apparatus within the portable wall unit.

BRIEF DESCRIPTION OF THE DRAWINGS

FIG. 1 is a perspective view of a portable wall unit constructed in accordance with the principles of the present invention and of partitions for rooms adjacent to the wall unit in the building in which it is to be installed;

FIG. 2 is a plan view of the portable wall unit and partitions of FIG. 1 installed at the building site with representative kitchen and bathroom appliances connected to the utility apparatus of the portable wall unit;

DESCRIPTION OF THE PREFERRED EMBODIMENTS

Figure 3:
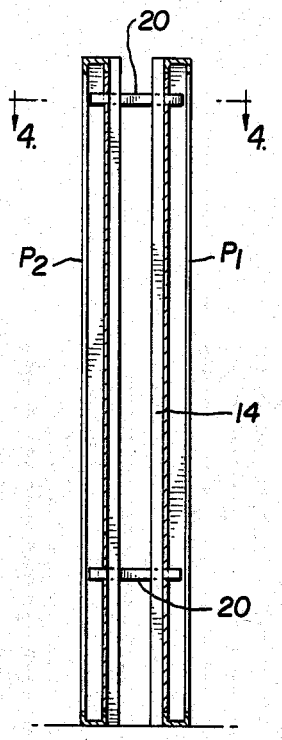
FIG. 3 is a sectional view taken substantially along line 3—3 of FIG. 2.
Figure 4:
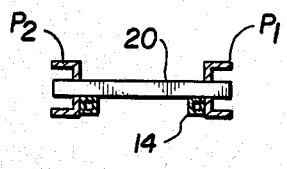
FIG. 4 is a sectional view taken substantially along line 4—4 in FIG. 3.

Referring to FIGS. 1, 3 and 4, the prefabricated building system of the present invention comprises a portable wall unit 10 having a supporting frame 12 formed of lightweight members 14 such as metal tubing, channel members or the like. In accordance with the principles of the present invention, the frame 12 may be of any suitable construction or materials.

Mounted on or secured to the frame 12 in any suitable manner are predetermined utility apparatus 16 which meets the requirements of adjacent rooms, such as bathrooms and/or kitchens in the building in which the portable wall unit 10 is to be installed. The utility apparatus 16 may comprise plumbing 18, electrical, heating and/or cooling requirements for the adjacent rooms. The plumbing 18 shown in the drawings is intended to represent whatever utilities, such as plumbing, electrical, heating and/or cooling, are required in the wall unit.

Preferably, the utility apparatus 16 is movably mounted on the frame 12 so that it can be adjusted thereon at the building site if necessary or desired. This can be accomplished in any suitable manner such as by clips 19 or the like that are adjustably or slidably mounted on the frame members 14 as shown in FIG. 1.

Figure 5:
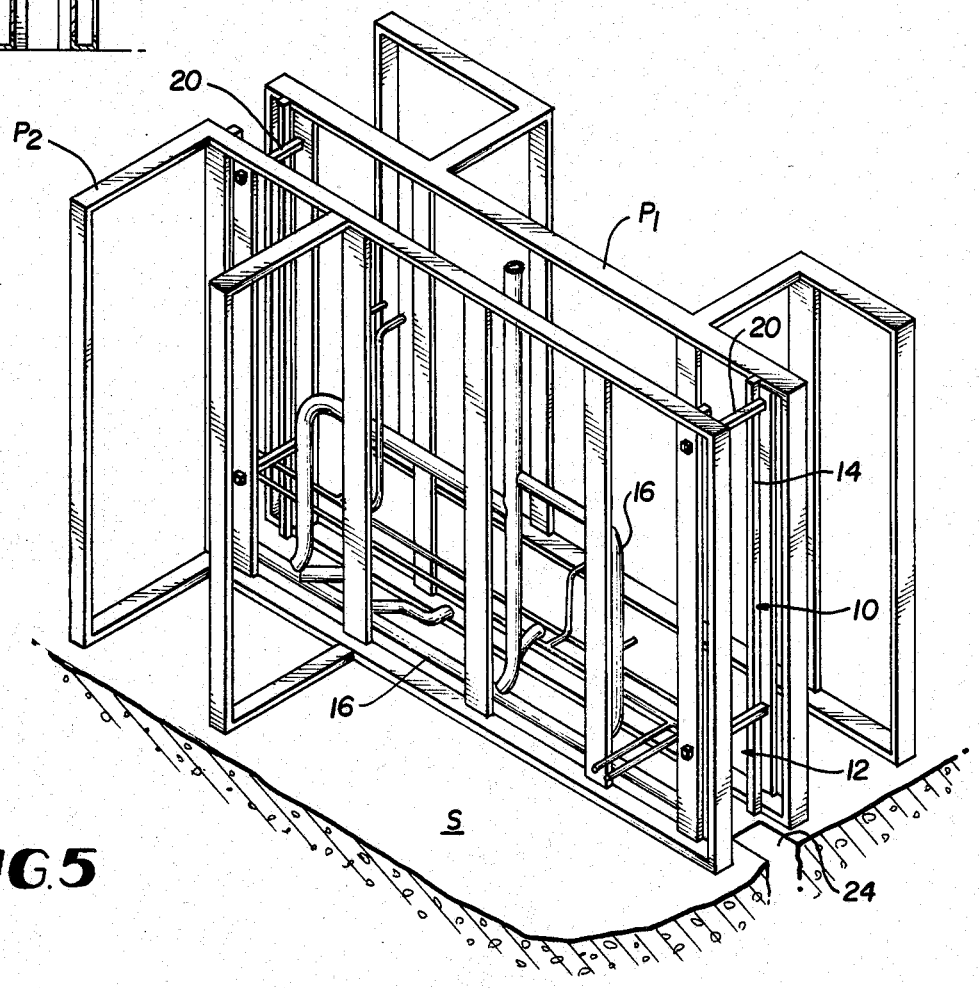
FIG. 5 is a perspective view showing the portable wall unit and prefabricated partitions of FIG. 1 installed on a slab at a building site.

In practice, the portable wall unit 10 preferably is assembled with the utility apparatus 16 at a manufacturing site and then is shipped to a building site where it is positioned on a slab S or the like in the manner shown in FIG. 5. The portable wall unit 10 may be preassembled with finished or unfinished partitions P1 and P2 for the adjacent rooms at the manufacturing site and then shipped as an assembled unit to the building site where the assembled unit is placed on the slab S, as shown in FIG. 5, or the portable wall unit can be shipped separately to the building site and then assembled with the adjacent wall partitions P1 and P2 on the slab S. An opening 24 may be formed in the slab S for connecting the utility apparatus to underground utilities or the like, if desired.

Preferably, the supporting frame 12 of the portable wall unit 10 is provided with aligning means, such as laterally extending members 20 having their ends extending beyond the frame 12, for the purpose of being received in apertures 22 in the adjacent wall partitions P1 and P2 to facilitate the alignment and the assembly of the wall unit 10 and the adjacent partitions P1 and P2.

In cases where the utility apparatus 16 of the portable wall unit 10 is to be connected to areas remote from the adjacent rooms in the building in which the wall unit is installed, the utility apparatus can be adjusted on the frame 12 so that it extends below the bottom of the frame and can be positioned in one or more grooves (not shown) preformed in the building slab S.

As shown in FIG. 2, after the portable wall unit 10 and the adjacent partitions P1 and P2 have been assembled on the building slab S, suitable utilities or appliances can be installed and readily connected to the utility apparatus 16 within the portable wall unit 10. As an illustrative example, if the wall partition P1 were formed for a bathroom, a bathtub 26, toilet 28, sink 30 and washer 32 could be installed on or adjacent to the partition P1 and connected to the utility apparatus 16 within the portable wall unit 10. If the wall partition P2 were formed for a kitchen, a water heater 34, stove 36, refrigerator 38 and heating and/or air conditioning unit 40 could be installed on or adjacent to the partition P2 and readily connected to the utility apparatus 16 of the portable wall unit 10.

From the foregoing description, it will be readily appreciated that the prefabricated building system and method of the present invention will result in reduced manufacturing costs, reduced labor costs and a considerable savings of time in the construction of homes or other buildings. Also, since the utility apparatus 16 of the portable wall unit 10 is prefabricated at the manufacturing site, it can be more accurately formed and assembled.

I claim:

1. A prefabricated building system comprising a portable wall unit having a supporting frame and utility apparatus mounted on said supporting frame, said utility apparatus being constructed to be connected to appliances in the building in which said portable wall unit is installed, wall partitions adapted to be connected to said portable wall unit, said wall partitions and said portable wall unit comprising aligning means for facilitating the connection thereof, and means for adjustably mounting said utility apparatus on said supporting frame, said aligning means comprising laterally extending members on said supporting frame and apertures in said wall partitions adapted to receive said laterally extending members therein to support, align and space said wall partitions.

2. The building system of claim 1, wherein said supporting frame is formed of lightweight tubular members.

3. The building system of claim 1, wherein said utility apparatus comprises plumbing and electrical apparatus.

4. The building system of claim 2 wherein said mounting means comprises clips movably mounted on said tubular members.

* * * * *